US006584700B1

(12) United States Patent
Hawkins

(10) Patent No.: US 6,584,700 B1
(45) Date of Patent: Jul. 1, 2003

(54) DRYING AND COOLING UNIT

(75) Inventor: Walter Hawkins, Delafield, WI (US)

(73) Assignee: Feeco International, Green Bay, WI (US)

( * ) Notice: Subject to any disclaimer, the term of this patent is extended or adjusted under 35 U.S.C. 154(b) by 0 days.

(21) Appl. No.: 09/480,214

(22) Filed: Jan. 10, 2000

(51) Int. Cl.[7] ..... D06F 58/00; F26B 11/02

(52) U.S. Cl. ..... 34/137; 34/130; 34/63; 34/65; 34/66; 432/78; 432/115

(58) Field of Search ..... 34/108, 360, 363, 34/391, 393, 394, 395, 424, 578, 63, 64, 65, 66, 135, 130, 435, 436, 499, 504, 505, 593, 137, 503, 136; 432/78, 115

(56) References Cited

U.S. PATENT DOCUMENTS 3,806,311 A * 4/1974 Barber ..... 432/115
3,851,406 A * 12/1974 Dumitru et al. ..... 34/578
4,014,642 A * 3/1977 Helming ..... 241/66
4,071,962 A 2/1978 Saeman
4,123,850 A * 11/1978 Niems ..... 34/432
4,147,503 A * 4/1979 Herchenbach et al. ..... 198/773
4,250,819 A * 2/1981 Pauli ..... 110/281
4,258,005 A * 3/1981 Ito et al. ..... 422/143
4,458,428 A * 7/1984 Saeman ..... 34/506
5,299,366 A * 4/1994 Maier et al. ..... 34/583
5,857,516 A 1/1999 Jordison et al.

* cited by examiner

*Primary Examiner*—Jiping Lu
(74) *Attorney, Agent, or Firm*—Philip M. Weiss; Weiss & Weiss

(57) ABSTRACT

A dryer-cooler unit comprising a single vessel wherein drying and cooling occur. The unit comprises a rotary dryer and a stationary discharge hood. Cooling air is distributed through the discharge hood.

8 Claims, 6 Drawing Sheets

DRYING AND COOLING UNIT

FIELD OF THE INVENTION

The present invention relates to drying and cooling functions all in a single unit.

BACKGROUND OF THE INVENTION

A great number of industrial drying processes invariably require a subsequent unit operation step, cooling. Cooling of a product from an industrial dryer may be required for a variety of reasons; material handling limitations, product stability considerations or possible additional process steps that may require a cooled product.

For applications wherein a rotary dryer is the equipment of choice, cooling generally involves a stand alone rotary cooler following the rotary dryer in series as separate units.

U.S. Pat. No. 4,071,962 details a combination rotary dryer-cooler wherein the drying and cooling occurs within a single rotary vessel. The weakness to this design relative to the present invention lies in the fact that the drying and cooling gases are combined at some midpoint within the rotary vessel. For certain applications, the cooling of dryer gases may result in water vapor condensation. Furthermore, control of the process may prove difficult since the two processes may oppose each other. The higher the drying demand, the less availability of cooling air since this cooling air is induced by a common source. Additionally, the higher the flow of drying gases, the hotter the product while the lower the capacity of cooling gases induced.

U.S. Pat. No. 5,857,516 discloses an indirect solids to fluid (typically water) heat exchanger. This design discloses a solids flow across heat exchange surfaces by gravity. The inherent advantage to the present invention lies in the much higher heat transfer coefficients that can be expected by aerated solids contacting heat exchange surfaces. Relative to quasinstatic sliding flow, the introduction of aeration air leads to potential evaporative cooling and always, direct convection.

SUMMARY OF THE INVENTION

The present invention comprises an integrated device that combines the drying and cooling functions in a single vessel. The present invention takes full advantage of a component common to most rotary dryers, the discharge hood or breaching. The discharge breaching is a stationary housing that joins the rotating vessel to stationary product handling equipment and exhaust ductwork (in the case of parallel flow designs) or heat source (in the case of counter-current designs). The discharge breaching may also serve a secondary purpose of being a large enclosure wherein gas velocities are reduced thereby acting as a dropout box for solids entrained in the gas stream. In the present invention, this component can be readily adapted to perform a tertiary function, product cooling.

The design of the present invention is based on modeling an airswept, direct convection rotary cooler wherein solids are in intimate contact with ambient or conditioned air. Since the breaching is stationary, a motive force for conveying the solids onward was sought. The dilemma was overcome since discharge breechings incorporate sloped sides for advance of material downward by gravity. The basic premise of the design was to use a gentler slope on the material side of the breaching face than otherwise required and then assist conveyance by the cooling air-performing aeration.

The mass of air required for cooling is based on the thermal load and the air being distributed evenly to the solids through a perforated plate or screen that becomes the slide surface of the discharge breaching. The cross sectional area of this aerated surface is determined by fluid flow characteristics such as pressure drop considerations and allowable upward gas velocity with respect to entertainment of solids. Additional considerations such as residence time for the solids in this cooling zone must also be taken into account when performing a design on this plate. The orientation and angle of this plate will be a function of rheology for any specific material.

There are many secondary benefits to the design of the present invention. Since the breaching is stationary, indirect cooling tubes could be incorporated without the need for additional structural support or rotary joints as would be encountered incomparable rotary water tube coolers. Since the solids are aerated and dynamic, solids to tube wall heat transfer coefficients are greatly enhanced from the more static, rotary water tube cooler design. Beat transfer can occur in a number of modes.

- Direct convection between solids and air flowing perpendicular to slide face (aeration)
- Direct convection for solids falling from rotary dryer through the up-running air flow
- Conduction between solids and slide surface
- Conduction between solids and optional indirect cooling tube surfaces
- Conduction between up-running cooling air and optional tube walls
- Evaporative cooling between hot moist solids and cool dry air Another benefit to utilizing the stationary design of the discharge breaching lies in the fact that separation between drying and cooling gases can readily be accomplished by incorporating baffles. The drying and cooling gases can be combined downstream in a common gas cleaning system if advantageous, or kept separate if so desired.

Critical to this design is the ability of the rotary dryer to discharge its product uniformly across the cooling grid surface. It is the intent of the present invention to incorporate two proven concepts, a serrated scroll ring or a trommel screen. In another embodiment, a hybrid combination of either or both in conjunction can be used.

The design of the present invention also lends itself well to augment a drying or heating function as opposed to product cooling. The design could also be adapted as a secondary dryer for slightly undersized rotary dryers in either new installations or as a "bolt on" retrofit for existing dryers.

The present invention provides improved heat transfer. The present invention provides lower gas volumes than pure convention designs. The present invention provides improved process-control through an independent supply fan and water flow. The present invention uses indirect heat exchange and is highly dynamic like an aerated fluid bed. There is a separation of drying and cooling gases. Further, the present invention can work by gravity flow. The present invention introduces cooling air to a component that is present on any dryer. The present invention does not use a pure fluid bed, the sloped nature of the invention leads to the ability to operate with a wide range of material consistencies.

DETAILED DESCRIPTION OF THE INVENTION

Figure 1:
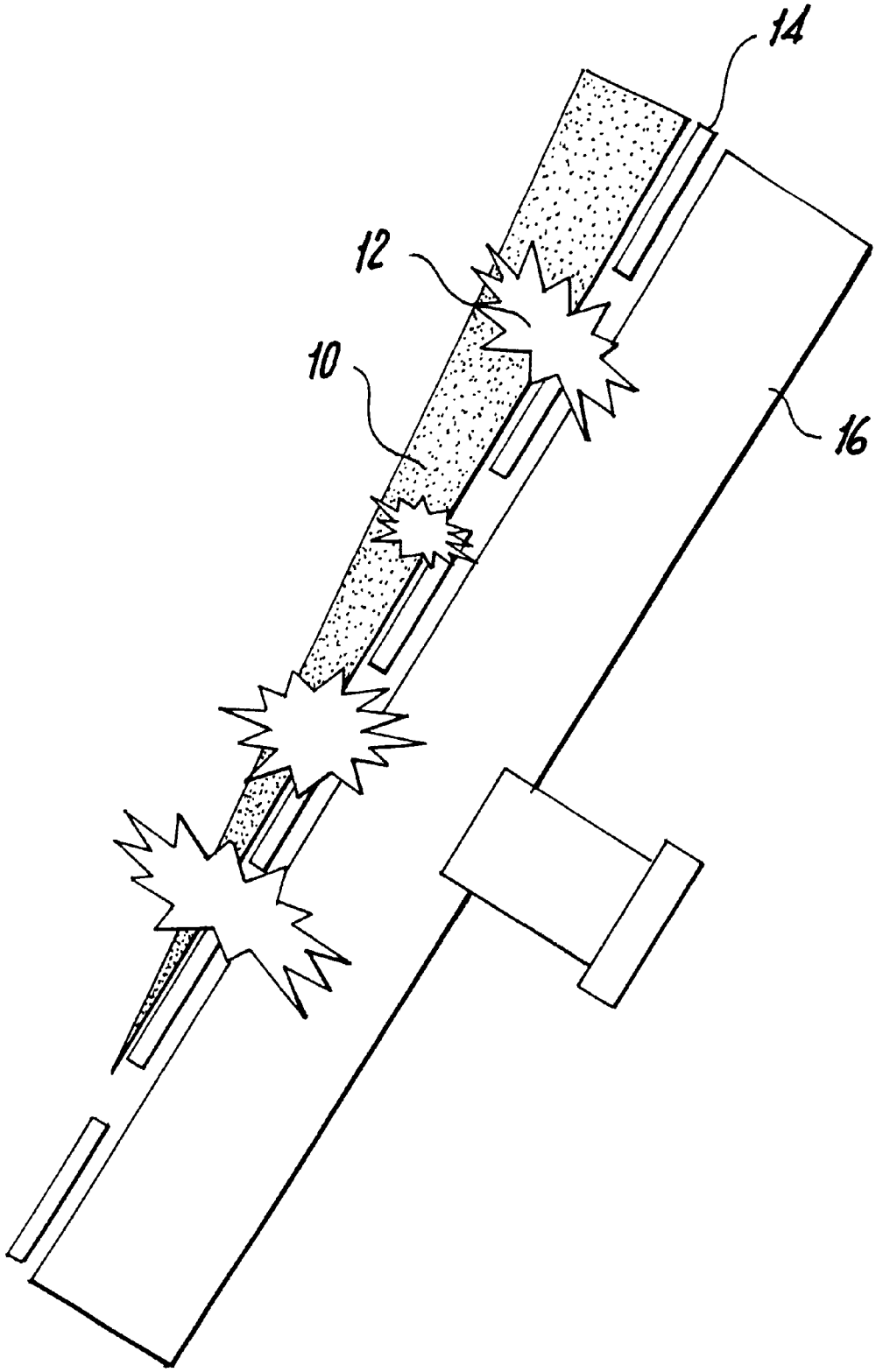
FIG. 1 illustrates an embodiment showing a cooling system of the present invention.

FIG. 1 shows an embodiment illustrating how direct convection of the present invention works. Aeration air or cooling air 12 is distributed through distribution plemun 16. Which distributes the air through distribution grid 14 onto a material bed 10. Distribution plemun 16 is a holding tank that evenly distributes air 12 through distribution grid 14.

Figure 2:
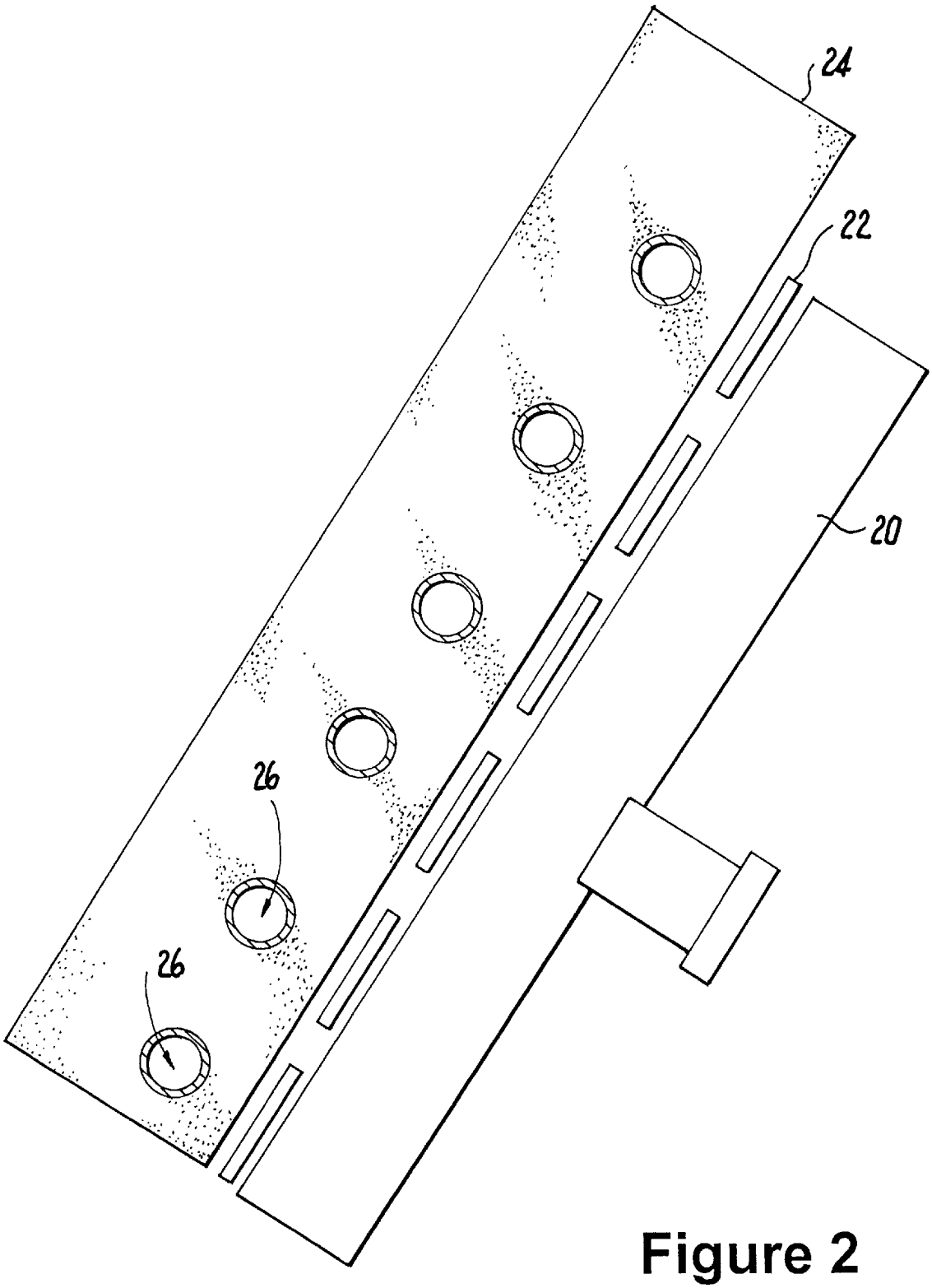
FIG. 2 illustrates an embodiment showing a cooling system of the present invention.

FIG. 2 shows another embodiment illustrating how conduction can work with the present invention. In this embodiment although cooling air can run through distribution grid 22 to the material bed 24, auxiliary cooling tubes 26 can also be used to provide cooling.

Figure 3:
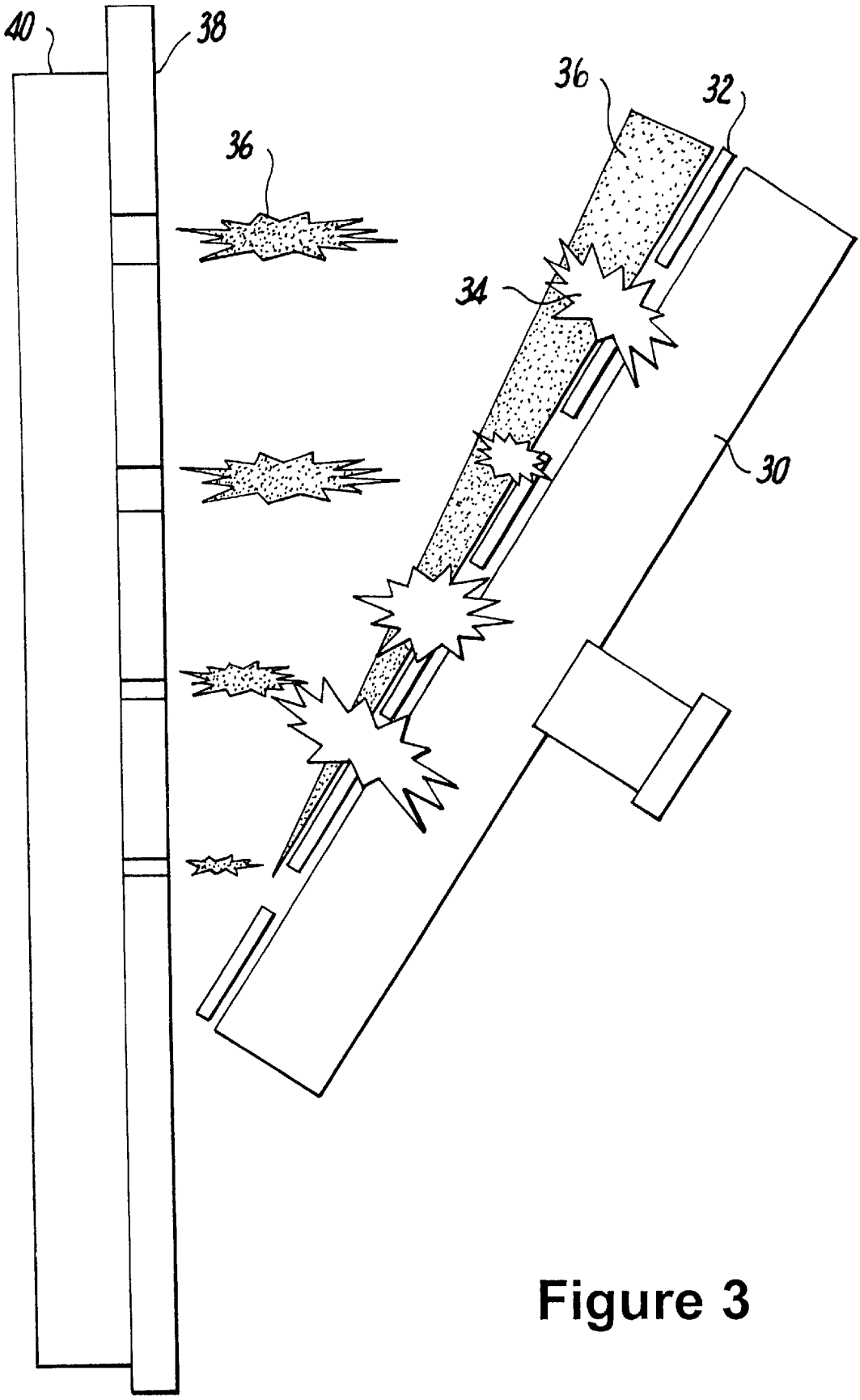
FIG. 3 illustrates an embodiment showing a dryer and cooling system of the present invention.

FIG. 3 shows how the material bed can be cooled off as it falls through holes in a rotary drum to a cooling system. Material bed 40 travels in a rotary drum. The rotary drum has a trommel screen or scroll which allows material 36 to fall through trommel screen 38 and be cooled by cooling air 34, as the cooling air is distributed from distribution plemun 30 through distribution grid 32 onto the new material bed 36.

Figure 4:
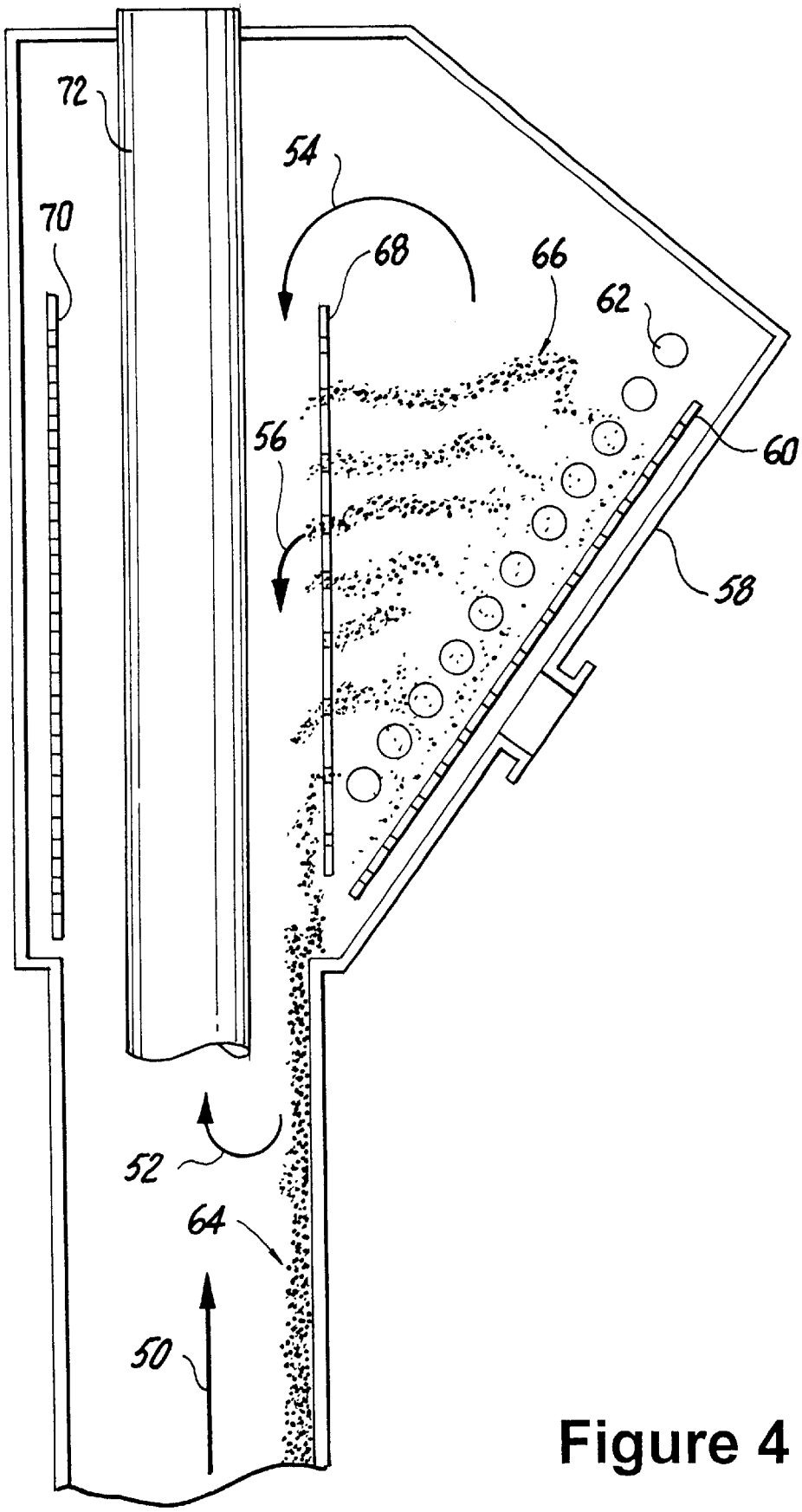
FIG. 4 illustrates an embodiment showing a dryer and cooling system of the present invention.

FIG. 4 illustrates a preferred embodiment which shows the material bed 64 being transported on trommel 68, wherein said material 66 falls through trommel screen 68 and is cooled by air produced by distribution plemun 58 which provides cooling air through grid 60. The material 66 is further cooled by contact with cooling tubes 62. Cool air is directed as shown in FIG. 4 as show by arrows 54 and 56. Cool exhaust gas is shown by the direction of arrow 52 and dryer hot gas flow is shown by arrow 50. A common gas collection point of hot and cool gases is shown at 72. A trommel or screen without any material on it is shown at 70.

Figure 5:
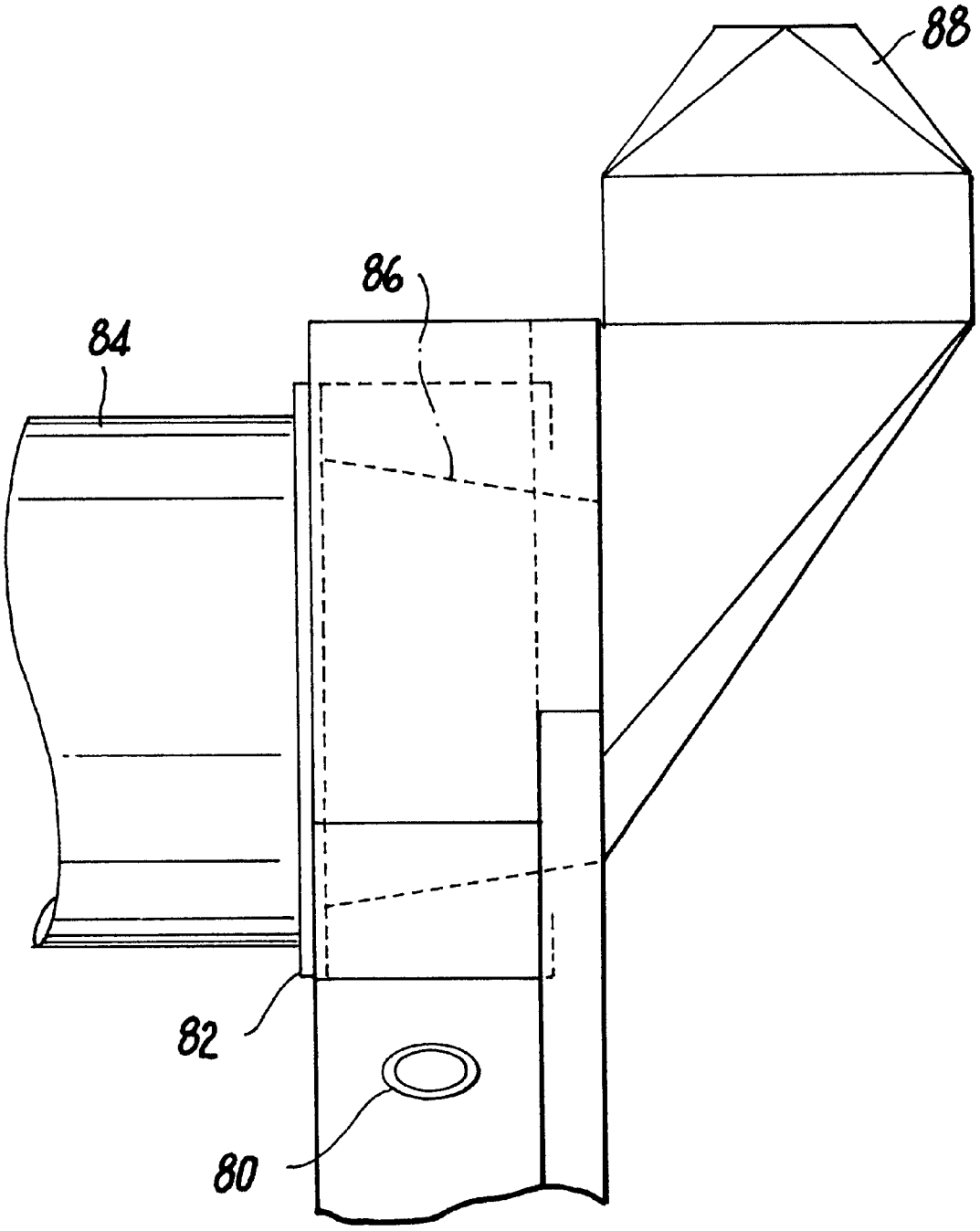
FIG. 5 illustrates an embodiment showing a dryer and cooling system of the present invention.

FIG. 5 shows a preferred embodiment wherein the rotary dryer 84 is followed by a cooling system wherein an interface seal 82 separates the rotary rotating dryer 84 from the stationary cooling hood. Cooling air is brought in through duct 80 from a fan. A conical baffel 86 separates dryer exhaust gas from cooler exhaust gas. The exhaust from the dryer goes to an air cleaning system via an exhaust port 86.

Figure 6:
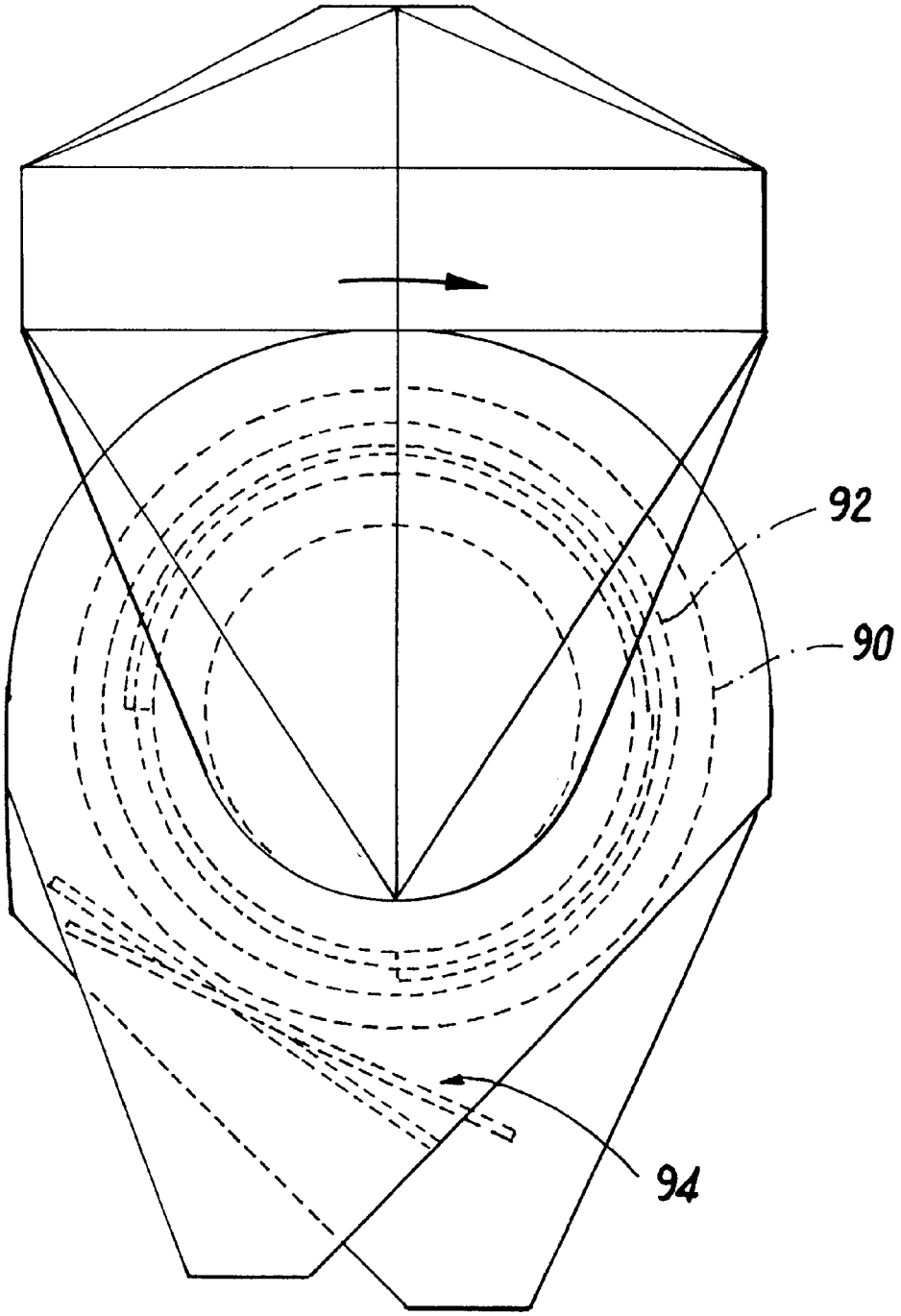
FIG. 6 illustrates an embodiment showing a dryer and cooling system of the present invention.

FIG. 6 illustrates a preferred embodiment showing rotary dryer 90. A conical baffel 92 separates the dryer air and the cooler air. Distribution grid 94 in a preferred embodiment is shown to be capable of pivoting on an angle that can be adjusted. The angle is a function of the material, density, etc.

While the invention has been particularly shown and described with reference to the preferred embodiment of the present invention, it will be understood by those skilled in the art that the foregoing and other changes in form may be made therein without departing from the spirit and scope of the invention.

What is claimed is:

1. A dryer-cooler unit comprising a single vessel:

said unit comprising a rotary dryer and a stationary discharge hood;

said discharge hood comprising a stationary housing that joins said rotary dryer to stationary product handling equipment and exhaust ductwork or a heat source;

wherein drying and cooling occur in said vessel;

cooling air is distributed through said discharge hood;

wherein said rotary dryer discharges its product uniformly across a cooling grid surface by using a serrated scroll ring, trommel screen or combination.

2. The dryer cooler unit of claim 1 wherein drying and cooling gases are separated by baffles.

3. The dryer cooler unit of claim 1 wherein cooling is done by aeration air or cooling air.

4. The dryer-cooler unit of claim 1 wherein said discharge hood further contains cooling tubes.

5. The dryer-cooler unit of claim 1 wherein said discharge hood contains a distribution grid and distribution plenum.

6. The dryer-cooler unit of claim 5 wherein said distribution grid pivots on an adjustable angle.

7. The dryer cooler unit of claim 1 wherein said discharge hood has sloped sides to advance material downward by gravity.

8. The dryer cooler unit of claim 1 further comprising:

an interface seal that separates said rotary dryer from said stationary cooling hood.

* * * * *